US005115950A

United States Patent [19]

Rohr

[11] Patent Number: 5,115,950

[45] Date of Patent: May 26, 1992

[54] DISPENSING CLOSURE WITH UNITARY STRUCTURE FOR RETAINING A PRESSURE-ACTUATED FLEXIBLE VALVE

[75] Inventor: Robert D. Rohr, Elgin, Ill.

[73] Assignee: Seaquist Closures a divison of Pittway Corporation, Mukwonago, Wis.

[21] Appl. No.: 640,640

[22] Filed: Jan. 14, 1991

[51] Int. Cl.[5] ..... B65D 37/00

[52] U.S. Cl. ..... 222/490; 215/232; 220/259; 222/212; 222/494

[58] Field of Search ..... 222/206, 212, 215, 490, 222/491, 494, 213; 215/232, 306; 220/259

[56] References Cited

U.S. PATENT DOCUMENTS

| | | | |
|---|---|---|---|
| 1,607,993 | 11/1926 | Lowey | 222/490 |
| 1,658,233 | 2/1928 | Falk | 222/490 |
| 1,825,553 | 9/1931 | Smith | 222/490 |
| 2,061,124 | 11/1936 | Walther | 221/60 |
| 2,743,852 | 5/1956 | Alberdi, Jr. | 222/494 |
| 2,802,607 | 8/1957 | Kalmbach, Jr. et al. | 222/490 |
| 2,937,795 | 5/1960 | Ciliberti | 222/490 |
| 3,067,787 | 12/1962 | Salk | 141/321 |
| 3,257,046 | 6/1966 | Kasson | 222/490 |
| 3,258,028 | 6/1966 | Donner | 137/508 |
| 3,258,175 | 6/1966 | Taylor | 222/490 X |
| 3,270,771 | 9/1966 | Morgan et al. | 137/525.3 |
| 3,366,261 | 1/1968 | Dewey | 215/11 |
| 4,513,891 | 4/1985 | Ham et al. | 222/213 |
| 4,728,006 | 3/1988 | Drobish et al. | 222/181 |
| 4,749,108 | 6/1988 | Dornsbusch et al. | 222/212 |
| 4,760,937 | 8/1988 | Evezich | 222/209 |
| 4,776,495 | 10/1988 | Vignot | 222/206 X |
| 4,874,369 | 10/1989 | Kulle et al. | 604/86 |
| 4,922,955 | 5/1990 | Uri | 137/496 |

FOREIGN PATENT DOCUMENTS 2354093 5/1975 Fed. Rep. of Germany ..... 222/491

OTHER PUBLICATIONS

Photograph A.

Two sides of one sheet entitled "Dukane Staking Configurations", Form No. 9839-B-78.

Two sides of one sheet entitled "Heavy Duty Ultrasonic 1000/1500/2000 Watt Thruster/Press System", Form No. 10227-K-86.

*Primary Examiner*—Michael S. Huppert

*Assistant Examiner*—Joseph A. Kaufman

*Attorney, Agent, or Firm*—Dressler, Goldsmith, Shore, Sutker & Milnamow, Ltd.

[57] ABSTRACT

A dispersing closure is provided for an opening in an squeeze-type container and includes a body defining a dispensing passage for communicating between the container interior and the container exterior through a container opening. A flexible, self-sealing valve is provided with a peripheral flange, and the valve is mounted in the body for opening in response to increased container pressure. The body is of unitary construction and is molded from thermoplastic material with an upstanding peripheral wall that is subsequently deformed over the valve flange to retain the valve in the body. A preferred process for making the closure includes the steps of molding a unitary closure body with a seat for the valve flange surrounded by a peripheral wall, disposing the valve flange on the seat, and then deforming an upper portion of the wall into a generally annular configuration extending radially inwardly to overlie the seat and clamp the valve flange between the seat and the deformed portion of the wall.

22 Claims, 5 Drawing Sheets

DISPENSING CLOSURE WITH UNITARY STRUCTURE FOR RETAINING A PRESSURE-ACTUATED FLEXIBLE VALVE

TECHNICAL FIELD

This invention relates to container closures, and more particularly to a squeeze-type container dispensing closure which opens to dispense a fluid product from the container when the container is squeezed and which automatically closes when the squeezing pressure is released.

BACKGROUND OF THE INVENTION AND TECHNICAL PROBLEMS POSED BY THE PRIOR ART

A variety of packages, including dispensing packages or containers, have been developed for personal care products such as shampoo, lotions, etc., as well as for other fluid materials. Closures for these types of containers typically have a flexible, self-sealing, slit-type dispensing valve mounted over the container opening. When the container is squeezed, the fluid contents of the container are discharged through the valve.

Some of these types of closures employ multiple piece housings or bodies in which the valve is mounted. While closures used for such packages may function generally satisfactorily, in some applications it can be desirable to eliminate multiple piece constructions. Further, there is a need for an improved closure which can be more easily manufactured and assembled with reduced manufacturing costs.

Also, it would be advantageous if such an improved closure could be provided with a design that would accommodate high speed, high quantity manufacturing techniques with a reduced product reject rate.

With some conventional designs, there is a danger that the flexible, self-sealing, dispensing valve may be partially or completely dislodged from the container closure. This would permit the container contents to spill out. Also, there is a danger that a small child might attempt to swallow the loose valve. In view of these potential problems, it would be desirable to provide a closure design having an improved valve sealing and retention capability.

In addition, it would be beneficial if the design of such an improved closure could accommodate use of the closure with a variety of conventional containers having a variety of conventional container finishes, such as conventional threaded and snap-fit attachment configurations.

SUMMARY OF THE INVENTION

The present invention provides a dispensing closure suitable for an opening in a squeeze-type container. The closure includes a body for attachment to the container at the container opening to define a dispensing passage for communicating between the container interior and exterior through the container opening.

Carried within the body is a flexible, self-sealing valve of the type which opens in response to increased container pressure. The valve has a peripheral flange disposed in the body to mount the valve in the dispensing passage.

The body is of unitary construction and is molded from thermoplastic material with (1) an annular seat around the dispensing passage for engaging the valve flange and (2) a first wall extending from the seat to define a cavity around the seat for receiving the valve flange.

The body has a second wall extending from the first wall. The second wall is deformed into a generally annular configuration extending radially inwardly from the first wall to overlie the seat and clamp the valve flange between the seat and the second wall.

The present invention also provides a novel process for making the dispensing closure. The process includes molding the body as a unitary structure from thermoplastic material with a peripheral wall extending from the seat to define a cavity around the seat for receiving the valve flange.

The valve is then disposed in the body to mount the valve in the dispensing passage with the valve flange on the seat.

Next, an upper portion of the peripheral wall is deformed into a generally annular configuration extending radially inwardly to overlie the seat and clamp the valve flange between the seat and the deformed portion of the wall. In a preferred embodiment, the deformation is effected by directing ultrasonic energy into the wall.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

Figure 1:
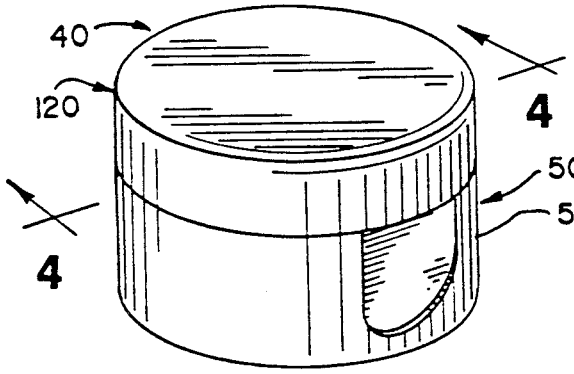
FIG. 1 is a perspective view of one form of a closure of the present invention showing an optional lid in a closed position on the closure.

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, the closure of this invention is described in the normal (upright) operating position, and terms such as upper, lower, horizontal, etc., are used with reference to this position. It will be understood, however, that the closure of this invention may be manufactured, stored, transported, used, and sold in an orientation other than the position described.

With reference to the figures, a first embodiment of the closure of the present invention is illustrated in FIGS. 1-6 and is represented generally in many of those figures by reference numeral 40. The closure 40 is adapted to be disposed on a container, (not illustrated) which has a conventional mouth or opening formed by a neck or other suitable structure. The closure 40 may be fabricated from a thermoplastic material, or other deformable materials, compatible with the container contents.

Figure 3:
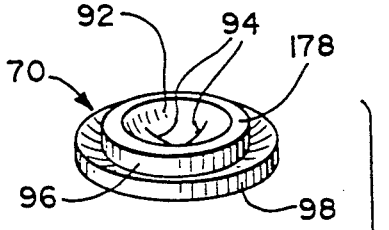
FIG. 3 is a fragmentary view similar to FIG. 2, but showing an exploded, perspective arrangement of the closure in an intermediate stage of manufacture.
Figure 2:
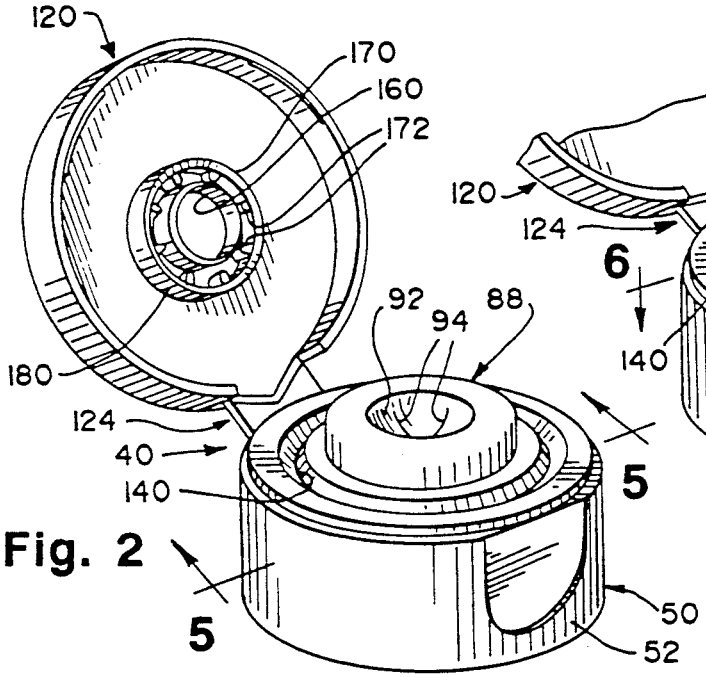
FIG. 2 is a perspective view of the closure in FIG. 1 shown with the lid in an open position.

As best illustrated in FIGS. 1-3, the closure 40 includes a housing, base, or body 50. In the illustrated embodiment, the housing or body 50 includes a peripheral wall in the form of a cylindrical skirt 52. The skirt 52 includes, on its interior surface, a conventional thread 54 or other suitable means (e.g., snap-fit bead (not illustrated)) for engaging suitable cooperating means such as a thread or other suitable means (e.g., snap-fit bead) on the container neck (not illustrated) to releasably secure the body 50 to the container.

Figure 4:
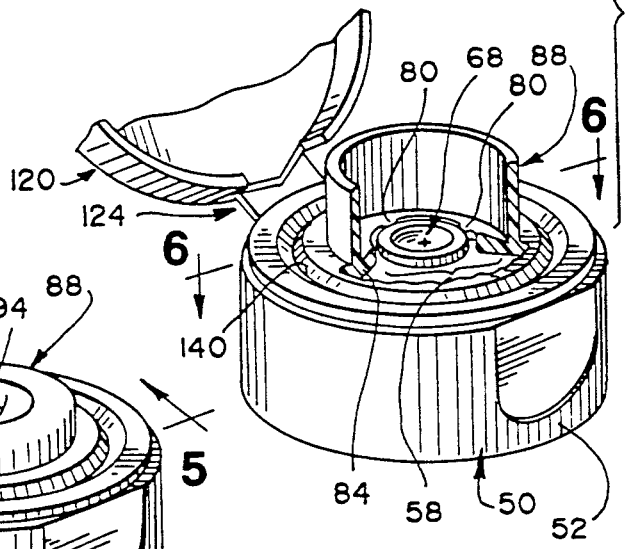
FIG. 4 is a greatly enlarged, fragmentary, cross-sectional view taken generally along the plane 4—4 in FIG. 1.
Figure 4:
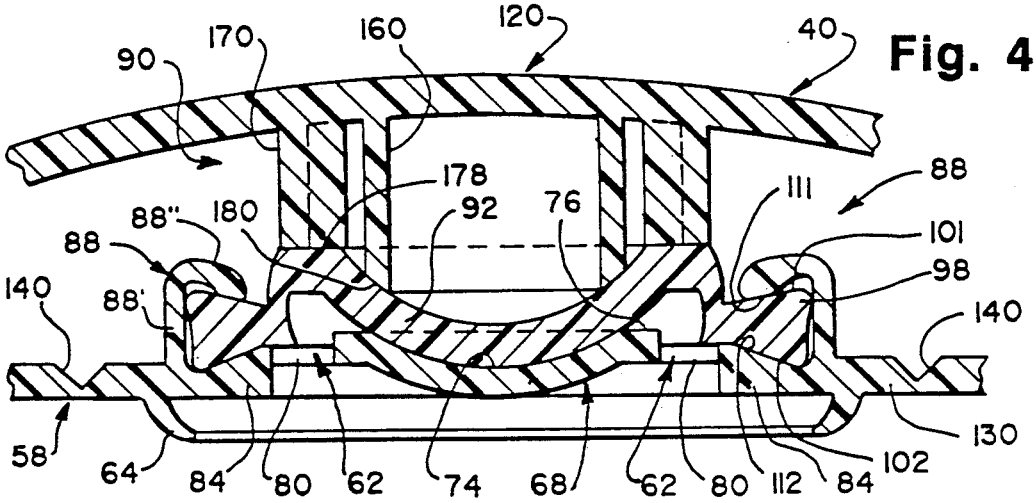
Figure 5:
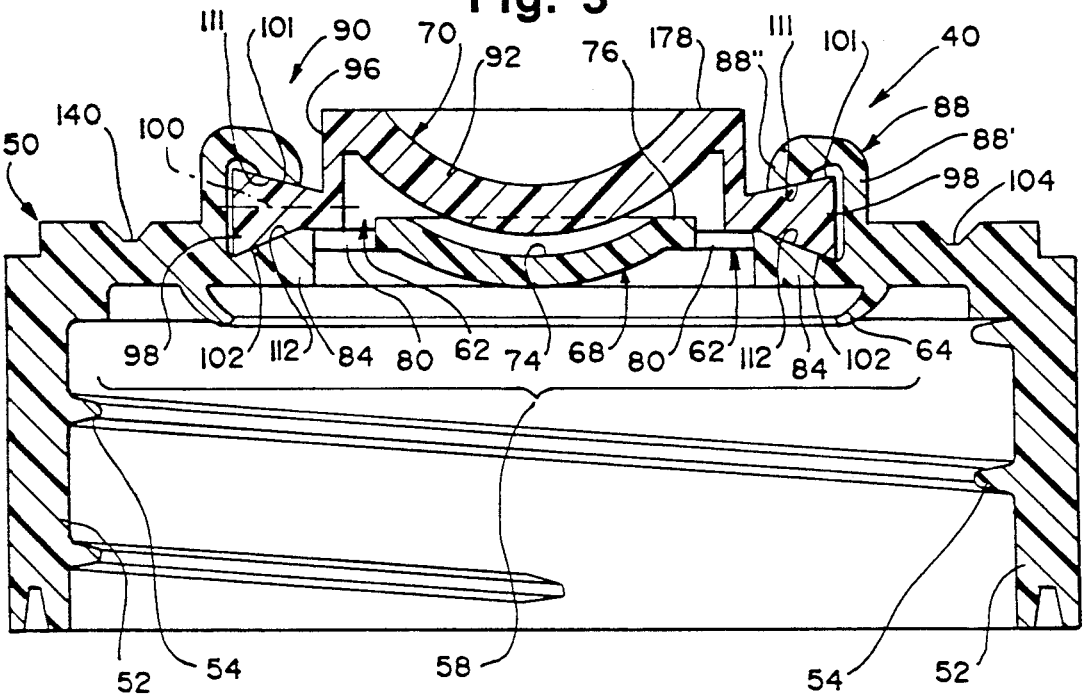
FIG. 5 is a greatly enlarged, cross-sectional view taken generally along the plane 5—5 in FIG. 2.
Figure 6:
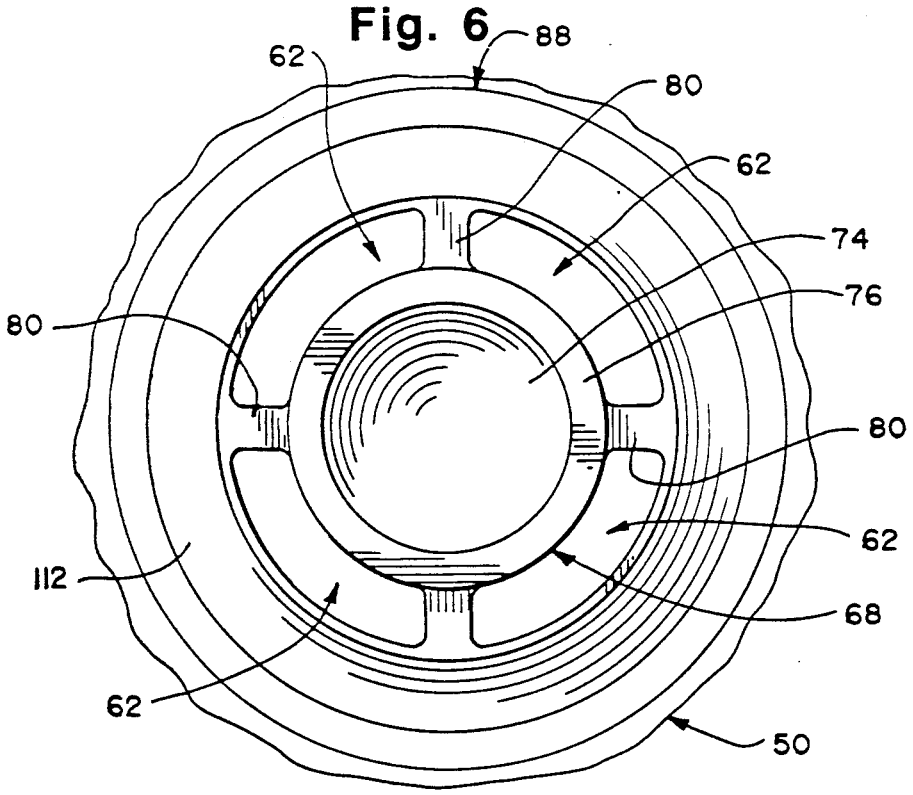
FIG. 6 is a fragmentary, plan view of the closure body taken generally along the plane 6—6 in FIG. 3.

In the first embodiment illustrated in FIGS. 1-6, the body 50 includes a top wall 58 (FIGS. 2, 4, and 5) which defines a divided dispensing passage 62 as best illustrated in FIGS. 4, 5 and 6. The dispensing passage 62 establishes communication between the container interior and exterior through the container opening defined by the container neck.

As best illustrated in FIG. 5, the body 50 includes an internal sealing ring 64 which projects downwardly from the underside of the top wall 58 and functions as a seal for protruding against or into the container neck for engaging a peripheral surface of the neck to effect a tight seal.

The closure body top wall 58 also includes a central support member 68 within the dispensing aperture 62 for supporting a dispensing valve 70 as described in more detail hereinafter.

The support member 68 has an upwardly facing concave surface 74 (FIGS. 5 and 6) which is surrounded by a flat, annular, peripheral surface 76. The support member 68 is maintained in position within the dispensing passage 62 by radially oriented arms 80 (FIG. 6) which extend from an annular seat or valve clamping member 84 (FIGS. 3 and 4).

The upwardly facing surface of the seat or clamping member 84 may be characterized as a seating surface or clamping surface 112 for engaging the valve 70 as will be described in detail hereinafter.

The closure body 50 is initially molded as a unitary construction from thermoplastic material in a configuration or "pre-form" which is subsequently deformed during the manufacturing process to retain the valve 70. In particular, the closure body 50 is molded with a peripheral wall 88 (FIG. 3) which extends upwardly from the body clamping member or seat 84 to define a cavity around the seat 84 for receiving the valve 70.

Subsequently, the valve 70 is disposed in the valve body to mount the valve 70 in the dispensing passage with the valve on the seat 84, and then the peripheral wall 88 is deformed, by a novel process described hereinafter, so that the wall 88 has a lower portion or first wall 88' that remains generally undeformed and so that the wall 88 has an upper portion or second wall 88" deformed into a generally annular configuration extending radially inwardly from the first wall 88'. The second wall 88" functions to overlie a portion of the valve 70 and clamp the valve 70 between the seat and the second wall 88" illustrated in FIG. 5.

As illustrated in FIGS. 3 and 5, the valve 70 includes a flexible central wall 92 which is disposed across at least a portion of the dispensing passage in the body 50. The valve central wall 92 defines at least one normally closed dispensing slit 94. Preferably, two such slits 94 are disposed at intersecting right angles to form a cross shape. Each slit 94 extends completely through the thickness of the central wall 92.

The valve central wall on 92 is surrounded by generally cylindrical portion 96 from which extends a flange 98. In the preferred form illustrated in the first embodiment of the closure shown in FIGS. 1-6, the valve flange 98 has a cross-sectional shape as viewed in FIG. 5 which may be characterized as a "dovetail" shape.

When the valve 70 is disposed in the closure body 50 in the dispensing passage 62, the valve peripheral flange 98 is oriented to define a central plane 100 (FIG. 5) that is generally transverse to the discharge passage 62. The thickness of the flange 98 normal to the plane is greater at the peripheral radial edge of the flange than inwardly thereof. The thickness of the valve flange 98 may also be characterized as decreasing with increasing distance from the flange peripheral edge. The flange 98 defines first and second engagement surfaces 101 and 102 which are symmetrically oriented on opposite sides of the central plane.

The valve 70 is securely retained in the closure body 50 by deforming the body wall 88 to engage the valve flange 98. To this end, the wall 88 is deformed so that the upper portion 88'' defines a first, or upper, clamping surface 111 to engage the surface 101 of the valve flange 98.

The first clamping surface 111 is spaced from the valve body lower, or second, clamping surface 112. Both clamping surfaces 111 and 112 are symmetrically arranged on opposite sides of the valve flange central plane 100 (FIG. 5). The spacing between the clamping surfaces 111 and 112 is less at a location adjacent the dispensing passage than at a location outwardly therefrom. That is, the spacing between the clamping surfaces increases with increasing distance from the dispensing passage.

Preferably, the surface profile of each clamping surface 111 and 112 generally conforms to the surface profile of the adjacent valve flange surface 101 and 102, respectively. Also, in the preferred embodiment, the valve flange engagement surfaces 101 and 102 diverge in a direction away from the dispensing passage in a uniform manner, such as at the constant taper angle illustrated.

Similarly, the spaced-apart clamping surfaces 111 and 112 also preferably diverge in a direction away from the dispensing passage in a uniform manner, such as at the constant taper angle illustrated. Preferably, and as illustrated in FIG. 5, the first clamping surface 111 on the wall 88'' has a frustoconical configuration, and the second clamping surface 112 on the closure body seat 84 also has a frustoconical configuration.

Figure 18:
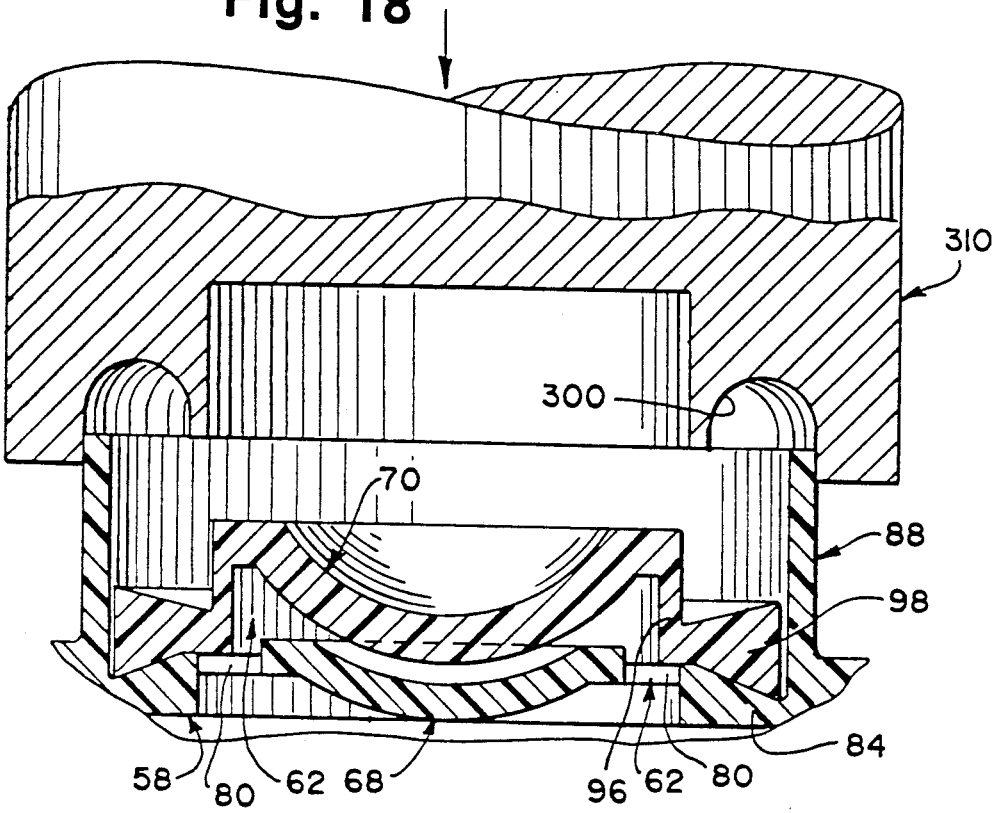
FIG. 18 is a fragmentary, cross-sectional view of the closure at the intermediate stage of manufacture shown in FIG. 3 and with an ultrasonic horn beginning to engage the closure body peripheral wall prior to deformation of the wall.

The above-described novel valve flange clamping structure is preferably formed by swaging or deforming the annular peripheral wall 88 (FIG. 3) by applying mechanical and ultrasonic energy to the wall 88 while guiding the deformation with a suitable forming surface. FIG. 18 illustrates an arcuate, concave forming surface 300 that defines an annular, downwardly open, channel in a generally cylindrical fixture or horn 310 that is attached in a conventional manner to a conventional ultrasonic thruster assembly (not illustrated).

The thruster assembly generates ultrasonic energy in the form of high frequency vibrations which are directed by the horn 310 into the peripheral wall 88 of the closure body. As the horn 310 vibrates at an ultrasonic frequency, the horn 310 is moved toward the closure body while engaging the exterior peripheral surface of the wall 88. The distal end portion of the wall 88 contacts the curved surface 300 and is urged radially inwardly.

Figure 19:
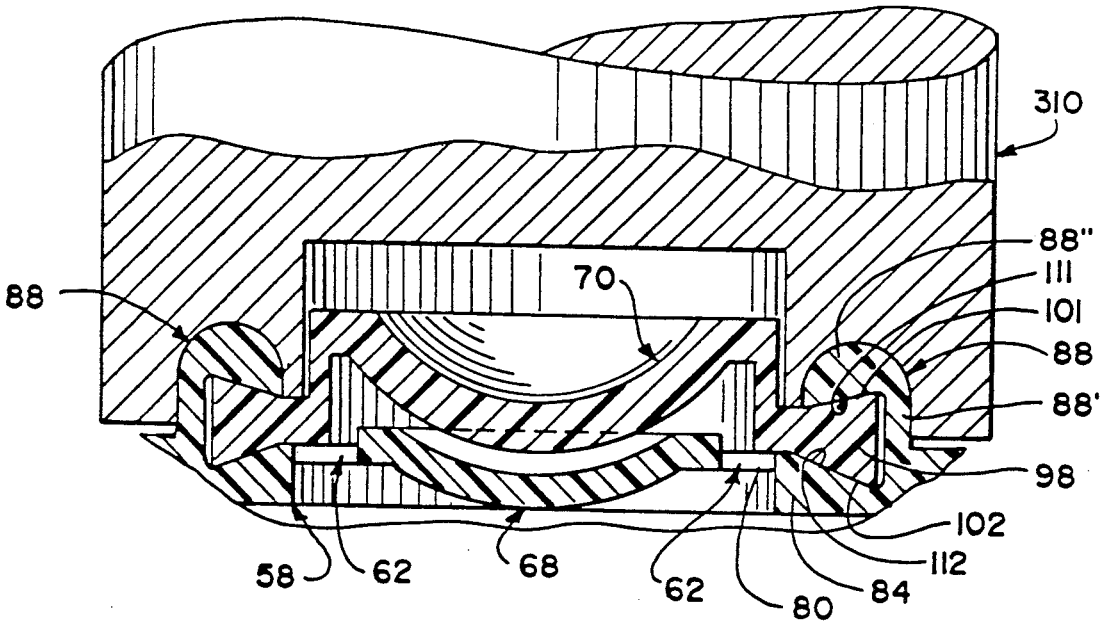
FIG. 19 is a view similar to FIG. 18, but after completion of the deformation of the closure body peripheral wall.

When sufficient ultrasonic energy is directed into the wall 88, localized heating by dissapation of the ultrasonic vibrations occurs, and the temperature of the wall 88 rises above the melting temperature of the wall material. The wall, or a portion thereof, begins to melt and deform. As the wall is deformed completely into engagement with the valve flange 98 as illustrated in FIG. 19, the wall portion 88'', which lies between the upper engagement surface 101 of the flange and the arcuate forming surface 300 of the horn, is formed so as to generally conform to the surfaces 101 and 300.

A conventional ultrasonic thruster assembly that may be used in the above-described process is the Model 48B2001 Thruster sold in the United States of America by Dukane Corporation, Ultrasonic Division, St. Charles, Ill. 60174 U.S.A. Such an assembly operates with an output power of 2,000 watts at an output frequency of 20 kilohertz with a maximum available clamping pressure of 540 pounds. The details of the structure and operation of such a conventional machine form no part of the present invention.

In one contemplated embodiment of the closure of the present invention, the closure body is initially molded from polypropylene so that the dispensing opening 62 has an outside diameter of about 0.504 inch as defined by the inner periphery of the valve seat 84. The frustoconical clamping surface 112 of the valve seat 84 slopes at an angle of about 22 degrees downwardly to the base of the peripheral wall 88 which has an inner diameter of about 0.705 inch. The outer diameter of the wall 88 is about 0.778 inch. The height of the wall, from the underside of the top wall 58 to the top end of the wall 88, is about 0.298 inch.

The step of swaging or otherwise deforming or reforming the peripheral wall 88 to securely clamp the peripheral flange 98 of the valve 70 may be effected with processes other than ultrasonic forming. The peripheral wall 88 may be reformed by engaging wall 88 with an appropriate tool to guide the bending or deformation of the wall 88, and heat may be introduced by other means, such as by chemical reaction, convection, etc. Also, depending upon the material from which the closure body is molded, the wall 88 could be cold formed to form the wall 88''.

The novel closure illustrated in FIGS. 1–6 provides a clamping arrangement which securely holds the valve 70 in the closure body without requiring special internal support structures or bearing members adjacent the interior surface of the valve cylindrical portion 96. This permits the region adjacent the interior surface of the cylindrical portion 96 to be substantially open, free, and clear so as to minimize any restriction on the flow of the container contents through the passage 62.

The valve 70 functions in a well-known manner. When the container (not illustrated), to which the closure 40 is mounted, is subjected to external forces, as when the container is squeezed to dispense the contents, the fluid material in the container is forced up against the valve 70 to temporarily deform the valve central portion 92 whereby the fluid material is discharged from the container through the slits 94. When the application of external pressure on the container is terminated, the inherent resilience of the valve material causes the valve to return to its normal, unstressed, closed orientation. Flexible, self-sealing valves of this type are well-known in the art. For example, see U.S. Pat. Nos. 1,607,993, 1,825,553, 2,802,607, 2,937,795 and 3,257,046.

The valve 70 may be fabricated from thermoplastic materials, such as polypropylene, polyethylene, copolyester elastomers, polyurethane, various styrenes, and chlorinated olefins. It is also contemplated that other materials may be used, such as thermoset materials, including silicone, natural rubber, and ethylene.

The closure may be provided with a lid 120. The lid 120 may be a separate, unconnected component which may be placed on, and removed from, the closure body 50. Preferably, the lid 120 is mounted to an edge of the closure body 50 as illustrated in FIG. 2. The lid is adapted to be pivoted between (1) a closed position (FIG. 1) over the closure top wall 58 and valve 70 and (2) an open position spaced away from the top wall 58 and valve 70 (FIG. 2).

In the preferred embodiment, the lid 120 is connected to the closure body 50 by suitable means, such as a snap-action hinge 124 as illustrated in FIG. 2. Such a snap-action hinge 124 is formed integrally with the closure housing 50 and lid 120. The illustrated snap-action hinge 124 is a conventional type described in U.S. Pat. No. 4,403,712.

Preferably, the lid 120 and closure body are molded as a unitary structure from suitable thermoplastic materials, such as polypropylene or polyethylene.

When the closure body is molded from thermoplastic materials, the provision of the flat annular surface 76 around the concave support member surface 74 aids in the molding process. This eliminates having to mold an acute angle at the peripheral edge of the concave surface 74. Such a sharp angle is difficult to mold and is more likely to break.

When a closure is applied to a container, there is a potential for distorting the closure and loosening the clamped valve 70. In particular, as the closure body 50 engages the top end surface of the neck of the container, the closure body top wall 58 begins to be pushed upwardly.

Because the closure top wall 58 is connected about its outer periphery to the side wall or skirt 52 of the closure body 50, the top wall 58 can have a tendency to move upwardly a greater amount at locations radially inwardly from the periphery of the closure body than it does at the outer periphery of the closure body. This could cause a "bowing" or "doming" of the top wall 58 which would cause the walls 88' and 88" to be expanded radially outwardly as well as axially upwardly. This could result in an increase in the diameter of the walls 88' and 88". As a consequence, the valve 70 could become loose in the walls 88' and 88".

The closure 40 can be provided with a unique structure that functions to overcome the "doming" tendency of the closure body 50 when it is applied to a container. Specifically, an annular channel 140 is defined in the top wall 58 radially outwardly of the wall 88'. Preferably, the channel 140 has a V-shaped cross-section and opens upwardly around the wall 88' to define a reduced thickness section in the top wall. This accommodates elongation of the section when the top wall 58 is engaged by the end of the container neck.

Specifically, when the upper end of the container neck engages the closure top wall (at seal 64 on the top wall 58), the portion of the top wall 58 radially inwardly of the annular channel 140 is moved upwardly with considerably less "doming" because the reduced thickness section below the channel 140 can deform and elongate. This acts as a flexure means or hinge means to some extent.

The portion of the top wall 58 radially inwardly of the channel 140 is thus pushed up with considerably less distortion, and the walls 88' and 88" tend to remain in the original, unstressed orientations. This means that the diameters of the walls 88' and 88" remain substantially unchanged as the closure is tightly engaged with the container neck. As a result, the valve 70 will remain securely retained within the closure 40.

Another feature of the preferred embodiment of the closure prevents inadvertent discharge or leakage of the container contents out of the closure. This feature relies on a unique cooperation between the closure lid 120, the valve 70, and the support member 68.

Specifically, the closure lid 120, as best illustrated in FIGS. 2 and 4, includes an annular sealing collar 160 for engaging the valve central wall 92 when the lid 120 is closed as illustrated in FIG. 4. The collar 160 forces the valve central wall 92 against the closure body support member 68 so as to seal the valve closed around the slits 94 (FIGS. 2 and 3).

Preferably, the lid 120 also includes an outer annular sleeve 170 that is shorter than the annular sealing collar 160. The lid 120 further includes lugs 172 which are circumferentially spaced apart around the inner periphery of the lid sleeve 170. The lugs 172 are unitary with the lid sleeve 170, and each lug 172 has an end surface that is coplaner with the sleeve end surface.

The lugs 172 and sleeve 170 function to force a peripheral, annular flat surface 178 of the valve 70 downwardly when the lid is closed (FIG. 4). This helps to deform the valve central wall 92 downwardly to conform with the support member 68 so that the valve slits 94 are effectively sealed within the annular sealing collar 160.

Further, to ensure that the sealing collar 160 effectively engages the valve central wall 92, the sealing collar 160 preferably has a frustoconical end surface 180. The frustoconical end surface 180 defines an angle that is equal to the angle of a line tangent to the support member concave surface 74 at a point axially aligned with a selected point on the end surface 180 when the lid is closed.

When the closure lid 120 is open, the valve 70, owing to its inherent resiliency, returns to its original, unstressed configuration (FIG. 5). In that configuration, the valve central wall 92 is spaced upwardly from the support member concave surface 74, and the valve cylindrical portion 96 assumes its original, unstressed cylindrical configuration. In this configuration, the contents of the container may pass up through the dispensing passage 62 and out through the valve 92 when the pressure of the liquid is sufficient to overcome the resilient closure forces of the valve 70.

The valve retention capability of the closure can be increased even more by providing at least one projecting protrusion on one or both of the clamping surfaces. The protrusions, such as teeth-like projections, spikes, ridges, and rings, would increase the retaining force because they would become embedded in the valve flange material or otherwise deform the valve flange material.

FIGS. 7-17 illustrate such additional valve retaining structures. These embodiments may be used to retain self-sealing, flanged valves. The particular valve internal configurations, wall thicknesses, curvatures of the valve central wall portions, etc. may be of any suitable design consistent with the valve mounting flange structure that is illustrated.

Figure 7:
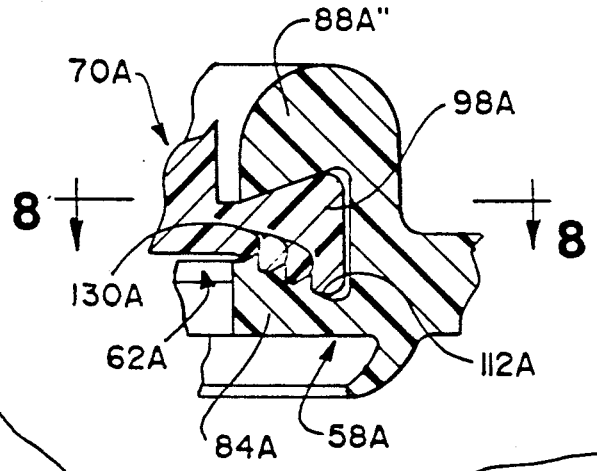
FIG. 7 is a fragmentary, cross-sectional view of a second embodiment of the closure of the present invention.
Figure 8:
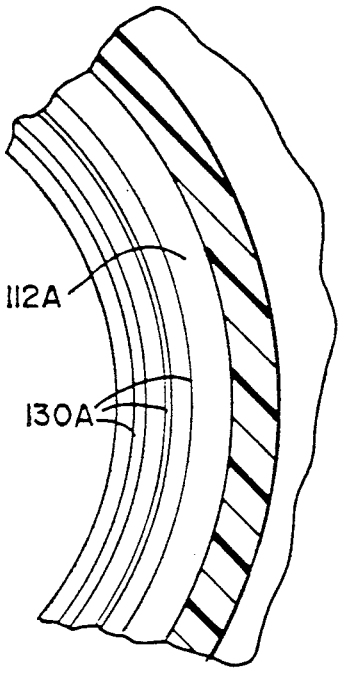
FIG. 8 is a fragmentary, cross-sectional view taken generally along the plane 8—8 with the valve omitted to illustrate interior detail.

FIGS. 7 and 8 illustrate a second embodiment of the invention wherein the closure body includes a top wall 58A defining the dispensing passage 62A. No valve support member, such as valve support member 68 shown in FIG. 3, is provided in this embodiment.

A self-sealing valve 70A is provided with a peripheral flange 98A which is seated on an upwardly facing surface 112A on the body seat 84A and which is clamped by an upper wall 88A". The clamping surface 112A includes protrusions 130A, and these protrusions 130A have the form of annular rings which each have a sharp edge for gripping the valve flange 98A.

Figure 9:
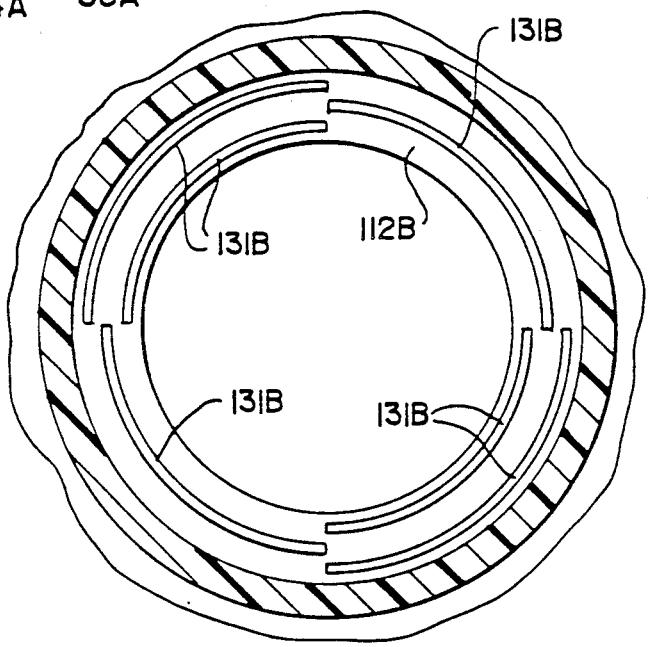
FIG. 9 is a fragmentary, plan view of a molded closure body of a third embodiment of the closure of the present invention shown with the valve omitted to illustrate interior detail.

FIG. 9 illustrates a modification wherein the closure body includes a valve flange seat having an upwardly facing clamping surface 112B which is provided with partial rings 131B in a segmented form. The ring arrangement may be divided as illustrated among four quadrants with a single ring segment 131B in each of two opposing quadrants and with two ring segments 131B in each of two other opposing quadrants. In the quadrants that have two ring segments 131B, the ring segments 131B are spaced-apart and are radially offset with respect to the single ring segments 131B in the adjacent quadrants. Each ring segment 131B may have a rectangular or square cross-sectional profile as illustrated. Alternatively, the ring segments 131B may have a sharp, inverted V-shaped profile similar to the profile of the rings 130A illustrated in FIG. 7 and 8.

Figure 10:
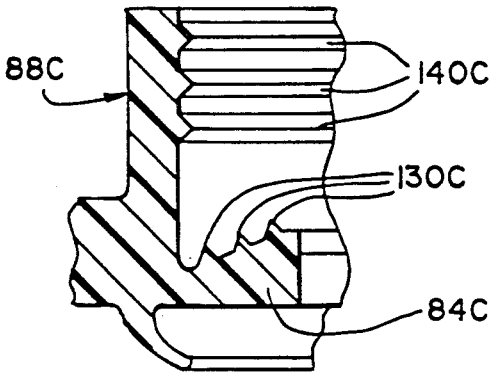
FIG. 10 is a fragmentary, cross-sectional view of the molded body of a fourth embodiment of the closure of the present invention illustrating an intermediate stage of manufacture before the valve is inserted and the peripheral wall is formed into engagement with the valve flange.

FIG. 10 illustrates another embodiment of the closure body—prior to insertion of the valve and deformation of the peripheral wall 88C. The closure body includes a seat 84C having sharp, annular rings 130C similar to the rings 130A described above with reference to FIGS. 7 and 8.

In addition, an upper portion of the peripheral wall 88C includes a plurality of inwardly directed, sharp rings 140C which may have the same cross-sectional configuration as the rings 130C.

Figure 11:
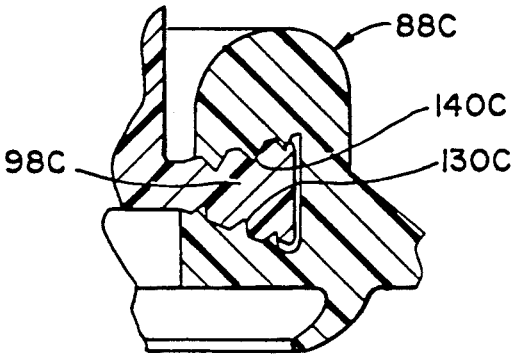
FIG. 11 is a fragmentary, cross-sectional view of the fourth embodiment of the closure of the present invention showing the assembled closure at the completion of manufacture.

When the wall 88C is deformed into engagement with the valve flange 98C as illustrated in FIG. 11, the rings 130C engage the bottom surface of the valve flange 98C, and the rings 140C engage the top surface of the flange 98C.

Figure 12:
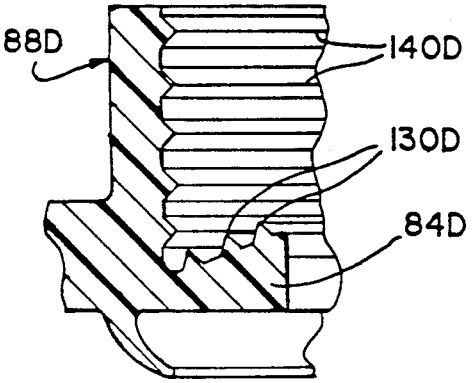
FIG. 12 is a fragmentary, cross-sectional view of a fifth embodiment of the closure of the present invention shown after molding the body, but prior to installation of the valve and prior to deformation of the body wall to engage the valve.
Figure 13:
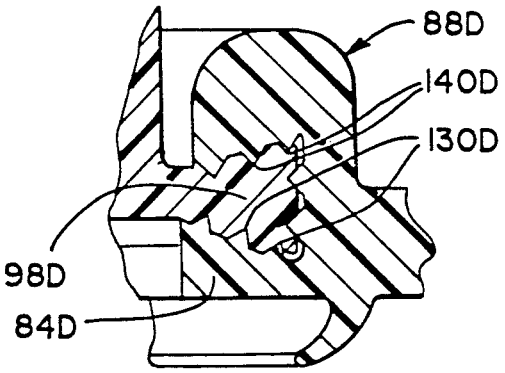
FIG. 13 is a fragmentary, cross-sectional view of the fifth embodiment of the closure in the fully assembled condition at the completion of manufacture.

The alternate embodiment illustrated in FIGS. 12 and 13 is similar to the above-described embodiment illustrated in FIGS. 10 and 11. However, in the embodiment illustrated in FIGS. 12 and 13, the closure body includes a peripheral wall 88D which has gripping rings 140D extending in a spaced-apart configuration over essentially the entire height of the interior surface of the wall 88D. The closure body also includes a valve seat 84D with gripping rings 130D.

When a valve is disposed in the closure body with the valve flange 98D seated on the seat 84D as illustrated in FIG. 13, the wall 88D can be deformed so that all of the peripheral surfaces of the flange 98D are engaged and gripped by the rings 130D and 140D.

Figure 14:
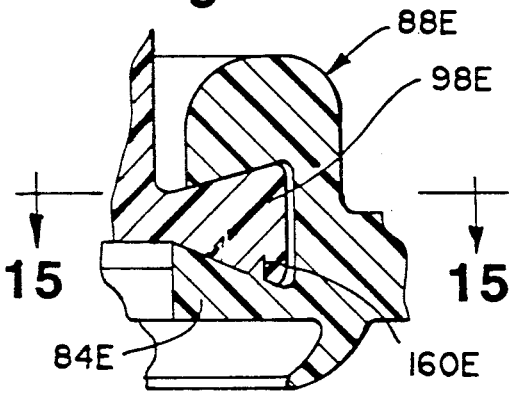
FIG. 14 is a fragmentary, cross-sectional view of a sixth embodiment of the closure of the present invention.
Figure 15:
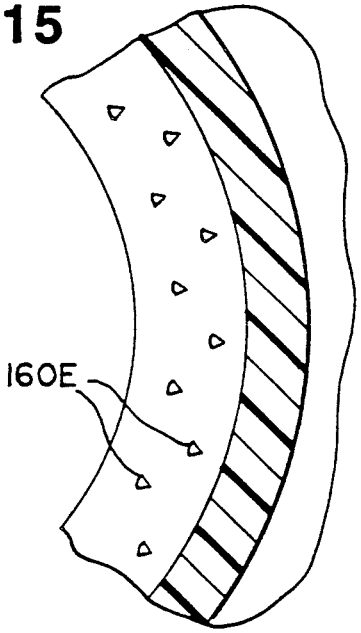
FIG. 15 is a fragmentary, cross-sectional view taken along the plane 15—15 in FIG. 14 but with the valve omitted to illustrate interior detail.

FIGS. 14 and 15 illustrate an alternate embodiment wherein a valve flange 98E is gripped between a valve seat 84E and a wall 88E. The seat 84E includes a plurality of upwardly projecting, spaced-apart spikes 160E which grip the underside of the valve flange 98E. These spikes 160E may be arranged, as best illustrated in FIG. 14, in two, concentric circles.

Figure 16:
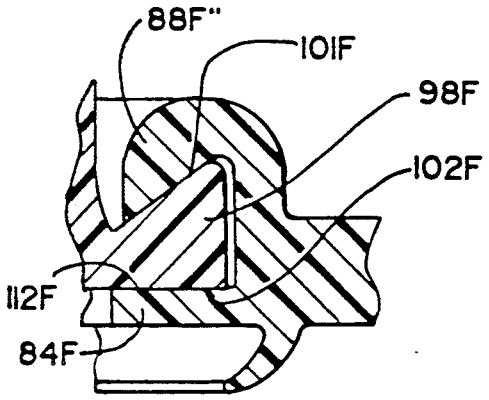
FIG. 16 is a fragmentary, cross-sectional view of a seventh embodiment of the closure of the present invention.

FIG. 16 illustrates an alternate form of the closure of the present invention wherein the closure body includes a valve flange seat 84F which has a generally flat flange-engaging surface 112F. The surface 112F does not slant downwardly with increasing radial distance. The surface 112F is adapted to engage and clamp a generally flat surface 102F of a self-sealing valve flange 98F.

The valve flange 98F has an upper surface 101F which slants upwardly with increasing radial distance. The surface 101F is engaged by a deformed wall 88F". If desired, protrusions, such as the above-described spikes or rings, could be provided on the seat clamping surface 112F and on the wall 88F".

Figure 17:
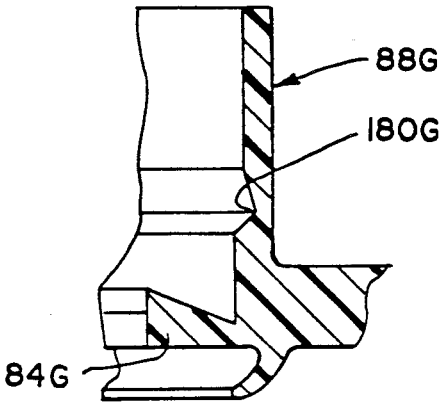
FIG. 17 is a fragmentary, cross-sectional view of a body of an eighth embodiment of the closure of the present invention shown after molding but prior to insertion of the valve and prior to deformation of the body wall to engage the valve.

FIG. 17 illustrates another embodiment of a closure body having an annular seat 84G for receiving the flange of a self-sealing valve (not illustrated). The closure body also includes an upwardly projecting, annular, peripheral wall 88G which can be deformed into engagement with the valve flange. Protrusions such as spikes or retaining rings could be provided if desired.

It is contemplated that, in some applications and for some materials and sizes, the inner surface of the wall 88G can be molded with an annular channel 180G. This reduces the thickness of the wall 88G which could cause the wall 88G to preferentially bend at that region. However, experiments have shown that, for some combinations of materials, configurations, and sizes, the thin section of material adjacent the channel 180G may function as an energy director and lead to an undesireable shearing at the channel 180G.

In all of the above discussed embodiments where it is a desired to provide protrusions on the clamping surfaces of the closure body, each protrusion may be provided in the form of an elongate member (e.g., tooth or spike) bent over near its base so as to extend generally radially outwardly relative to the dispensing passage and generally parallel to the engagement surface of the valve flange. With such an arrangement, forces tending to pull the valve flange inwardly and upwardly out of the closure body will cause the "bent over" spikes to engage the flange and be forced radially inwardly. This would tend to urge the spikes to pivot away from the "bent over" position toward a vertical position. This would increase the engagement between the spikes and the valve flange and contribute to increased reaction forces for retaining the valve flange.

It will be readily observed from the foregoing detailed description of the invention and from the illustrations thereof that numerous variations and modifications may be effected without departing from the true spirit and scope of the novel concepts or principles of this invention.

What is claimed is:

1. A dispensing closure suitable for an opening in a squeeze-type container, said closure comprising:

a body for attachment to said container at said container opening, said body defining a dispensing passage for communicating between the container interior and exterior through said container opening, said body being of unitary construction and molded from thermoplastic material;

a flexible, self-sealing valve of the type which opens in response to increased container pressure, said valve having a peripheral flange disposed in said body to mount said valve in said dispensing passage; and said body having (1) an annular seat around said dispensing passage for engaging said valve flange, (2) a first wall extending from said seat to define a cavity around said seat for receiving said valve flange, and (3) a second wall that extends from, and is unitary with, said first wall and that has been permanently deformed relative to said first wall into a generally annular configuration extending radially inwardly from said first wall to overlie said seat to clamp said valve flange between said seat and said second wall.

2. A closure in accordance with claim 1 in which (a) said valve flange has an outer peripheral edge and is oriented to define a central plane generally transverse to said discharge passage, the thickness of said flange normal to said plane decreasing with increasing distance from said flange peripheral edge, said flange defining first and second engagement surfaces symmetrically arranged on opposite sides of said central plane; and (b) said deformed second wall and said seat define generally opposed, spaced-apart, clamping surfaces for clamping said valve flange engagement surfaces, the spacing between said clamping surfaces increasing with increasing distance from said dispensing passage, said clamping surfaces being symmetrically arranged on opposite sides of said valve flange central plane.

3. The closure in accordance with claim 1 in which (a) said valve flange defines a central plane generally transverse to said discharge passage, the thickness of said flange normal to said plane being greater at the peripheral radial edge of said flange than inwardly thereof, said flange defining first and second engagement surfaces symmetrically arranged on opposite sides of said central plane; and (b) said deformed second wall and said seat define generally opposed, spaced-apart, clamping surfaces for clamping said valve flange engagement surfaces, the spacing between said clamping surfaces being less at a location adjacent said dispensing passage than at a location outwardly therefrom, said clamping surfaces being symmetrically arranged on opposite sides of said valve flange central plane.

4. The closure in accordance with claim 1 in which said valve flange has two engagement surfaces;

said second wall has a clamping surface in engagement with one of said valve flange engagement surfaces;

said seat has a clamping surface in engagement with the other one of said valve flange engagement surfaces; and the surface profile of each said clamping surface generally conforms to the surface profile of the valve engagement surface with which it is engaged.

5. The closure in accordance with claim 4 in which said clamping surfaces diverge in the direction away from said dispensing passage.

6. The closure in accordance with claim 4 in which said valve flange engagement surfaces diverge in the direction away from said dispensing passage.

7. The closure in accordance with claim 4 in which each said clamping surface has a frustoconical configuration.

8. The closure in accordance with claim 1 in which said valve includes a cylindrical wall that projects from the inner radius of said valve flange and that defines an interior surface; and said closure body defining an annular clearance adjacent and radially inwardly of the interior surface of said valve cylindrical wall.

9. The closure in accordance with claim 1 in which said valve has a flexible central wall that is disposed across at least a portion of said dispensing passage and that defines at least one normally closed dispensing slit;

said body includes a support member spaced below said valve central wall; and said closure includes a lid for being disposed on said body in a closed position over said valve, said lid including an annular sealing collar for forcing said valve central wall against said support member to seal said valve closed around said slit.

10. The closure in accordance with claim 9 in which said lid includes an annular sleeve concentric with, and radially outwardly of, said annular sealing collar, said sleeve having a planar, annular, end surface for engaging said valve when said lid is closed.

11. The closure in accordance with claim 10 in which said lid sleeve is shorter than said lid sealing collar.

12. The closure in accordance with claim 10 further including lugs that are circumferentially spaced apart around the inner periphery of said lid sleeve, that are unitary with said lid sleeve, and that each have an end surface that is coplanar with said sleeve end surface.

13. The closure in accordance with claim 1 in which at least one of said seat, first wall, and second wall includes a projecting protrusion to aid in retaining said valve flange in said body.

14. The closure in accordance with claim 13 in which said protrusion includes a ridge of material defining an edge for deforming said valve flange.

15. The closure in accordance with claim 13 in which at least one of said seat, first wall, and second wall includes a plurality of said protrusions, each protrusion having the form of a spike, said spikes being arranged in a spaced-apart, circular array.

16. The closure in accordance with claim 13 in which at least one of said seat, first wall, and second wall includes a plurality of said protrusions, each protrusion having the form of an annular ring.

17. A dispensing closure suitable for an opening in a squeeze-type container, said closure comprising:

a body for attachment to said container at said container opening, said body defining a dispensing passage for communicating between the container interior and exterior through said container opening, said body being of unitary construction and molded from thermoplastic material;

a flexible, self-sealing valve of the type which opens in response to increased container pressure, said valve having a peripheral flange disposed in said body to mount said valve in said dispensing passage; and said body having (1) an annular seat around said dispensing passage for engaging said valve flange, (2) a first wall extending from said seat to define a cavity around said seat for receiving said valve flange, (3) a second wall that extends from said first wall and that is deformed into a generally annular configuration extending radially inwardly from said first wall to overlie said seat to clamp said valve flange between said seat and said second wall, and (4) a skirt with securing means for engaging cooperating means on said container, said body further having a top wall extending inwardly from said skirt to define said dispensing passage, seat, first wall, and second wall, said body including flexure means for permitting outward displacement of said seat, first wall, and second wall with a minimum of distortion, said flexure means including an annular channel located in said top wall radially outwardly of said first wall to define a reduced thickness section of said top wall to accommodate elongation of said section when said top wall is engaged by said container.

18. The closure in accordance with claim 17 in which said annular channel has a generally V-shaped cross-section.

19. A dispensing closure suitable for an opening in a squeeze-type container, said closure comprising:

a body for attachment to said container at said container opening, said body defining a dispensing passage for communicating between the container interior and exterior through said container opening, said body being of unitary construction and molded from thermoplastic material;

a flexible, self-sealing valve of the type which opens in response to increased container pressure, said valve having a peripheral flange disposed in said body to mount said valve in said dispensing passage;

said body having (1) an annular seat around said dispensing passage for engaging said valve flange, (2) a first wall extending from said seat to define a cavity around said seat for receiving said valve flange, and (3) a second wall that extends from said first wall and that is deformed into a generally annular configuration extending radially inwardly from said first wall to overlie said seat to clamp said valve flange between said seat and said second wall;

said valve having a flexible central wall that is disposed across at least a portion of said dispensing passage and that defines at least one normally closed dispensing slit;

said body including a support member spaced below said valve central wall;

said closure including a lid for being disposed on said body in a closed position over said valve, said lid including an annular sealing collar for forcing said valve central wall against said support member to seal said valve closed around said slit;

said valve central wall being concave; and said support member having a concave surface for engaging said valve central wall.

20. The closure in accordance with claim 19 in which said sealing collar has a frustoconical end surface defining an angle equal to the angle of a line tangent to said support member concave surface at a point axially aligned with a selected point on said end surface when said lid is closed.

21. A dispensing closure suitable for an opening in a squeeze-type container, said closure comprising:

a body for attachment to said container at said container opening, said body defining a dispensing passage for communicating between the container interior and exterior through said container opening, said body being of unitary construction and molded from thermoplastic material;

a flexible, self-sealing valve of the type which opens in response to increased container pressure, said valve having a peripheral flange disposed in said body to mount said valve in said dispensing passage;

said body having (1) an annular seat around said dispensing passage for engaging said valve flange, (2) a first wall extending from said seat to define a cavity around said seat for receiving said valve flange, and (3) a second wall that extends from said first wall and that is deformed into a generally annular configuration extending radially inwardly from said first wall to overlie said seat to clamp said valve flange between said seat and said second wall.

said valve having a flexible central wall that is disposed across at least a portion of said dispensing passage and that defines at least one normally closed dispensing slit;

said body including a support member spaced below said valve central wall;

said closure including a lid for being disposed on said body in a closed position over said valve, said lid including an annular sealing collar for forcing said valve central wall against said support member to seal said valve closed around said slit; and said support member having a circular, concave surface surrounded by a flat, annular, peripheral surface.

22. A dispensing closure suitable for an opening in a squeeze-type container, said closure comprising:

a body having a skirt for attachment to said container at said container opening, said body having a generally transverse top wall defining a dispensing passage for communicating between the container interior and exterior through said container opening, said body being of unitary construction and molded from thermoplastic material;

a flexible, self-sealing valve of the type which opens in response to increased container pressure, said valve having a peripheral flange disposed in said body to mount said valve in said dispensing passage and said valve flange having outwardly diverging engagement surfaces; and said body having (1) an annular seat defining a tapered clamping surface around said dispensing passage for engaging said valve flange, said seat including gripping protrusions projecting from said clamping surface to grip said valve flange, (2) a first wall extending from said seat to define a cavity around said seat for receiving said valve flange, and (3) a second wall that extends from, and is unitary with, said first wall and that has been permanently deformed relative to said first wall into a generally annular configuration extending radially inwardly from said first wall to overlie said seat to clamp said valve flange between said seat and said second wall, said deformed second wall having a tapered clamping surface for engaging said valve flange.

* * * * *